United States Patent [19]

Viteretto

[11] 4,067,532

[45] Jan. 10, 1978

[54] REMOVABLE TWO-PART FASTENING FOR TEMPORARILY HANGING AN OBJECT FROM A SURFACE

[76] Inventor: James F. Viteretto, 214 Sheephill Road, Riverside, Conn. 06878

[21] Appl. No.: 701,305

[22] Filed: June 30, 1976

[51] Int. Cl.[2] ..... A47G 29/00

[52] U.S. Cl. ..... 248/359; 248/205 A; 248/222.4

[58] Field of Search ..... 248/359, 360, 222.2, 248/222.4, 223.2, 224.1, 224.2, 224.4, 225.1, 220.2, 205 A, 467, 481, 274, 276; 403/56; 179/153

[56] References Cited

U.S. PATENT DOCUMENTS

| | | | |
|---|---|---|---|
| 1,910,864 | 5/1933 | Szyminski | 248/481 |
| 1,938,541 | 12/1933 | Oishei | 248/481 |
| 2,615,368 | 10/1952 | Bindley | 248/481 |
| 2,846,732 | 8/1958 | Burns | 403/56 X |
| 2,968,995 | 1/1961 | Holden | 248/481 X |
| 3,029,547 | 4/1962 | Ross et al. | 248/359 X |
| 3,389,883 | 6/1968 | Johnson | 248/360 X |
| 3,604,673 | 9/1971 | Klein | 248/467 |
| 3,666,225 | 5/1972 | Weinberger | 248/205 A |
| 3,881,677 | 5/1975 | Ihlenfeld | 248/224.1 X |

FOREIGN PATENT DOCUMENTS

| | | | |
|---|---|---|---|
| 959,537 | 3/1950 | France | 248/359 |
| 1,275,394 | 8/1968 | Germany | 248/481 |

*Primary Examiner*—J. Franklin Foss

*Attorney, Agent, or Firm*—Robert Ames Norton; Saul Leitner

[57] ABSTRACT

A two part removable fastening attachment temporarily hanging an article, such as a telephone receiver, garden tool, hammer or the like, on a vertical surface against which the article can hang. The attachment is of the two part ball and socket type, with a socket which surrounds the ball on all but one open side which permits sliding of the ball into the socket, the ball then contacts the portion of the socket surrounding it. The ball is attached to the vertical surface and the socket is attached to the article with the open side down and is free to move down over the ball until its upper surrounding portion engages the ball. The attachment is molded of plastic for light articles, but metal may be used for heavier articles. The ball and socket elements are each provided with an integral base having a generally flat surface to conform to the article and the support. The flat surfaces of the bases are preferably provided with two-side pressure sensitive adhesive tape for attachment purposes, however, other methods of attachments may be used.

3 Claims, 3 Drawing Figures

Fig. 1.
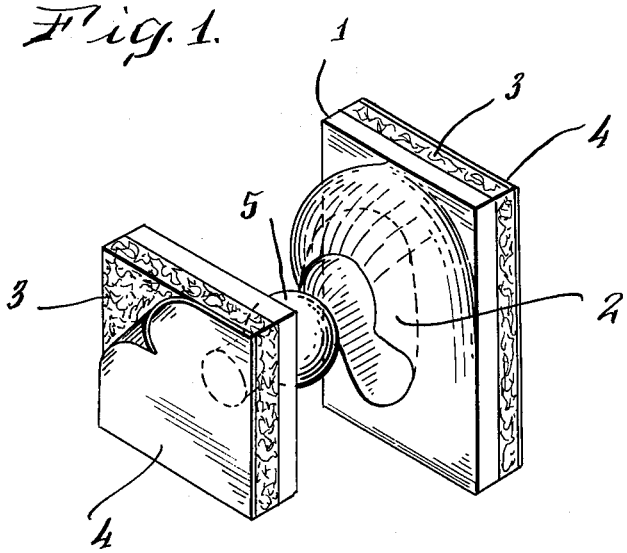
Fig. 2.
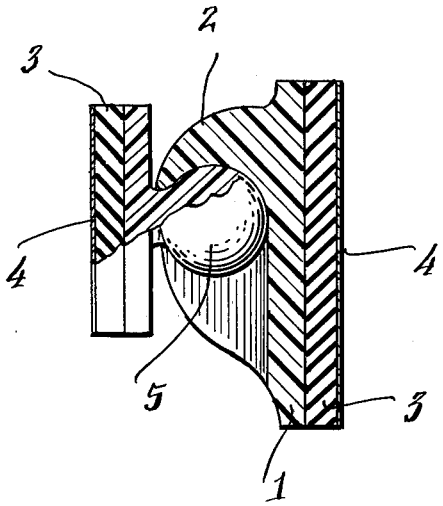
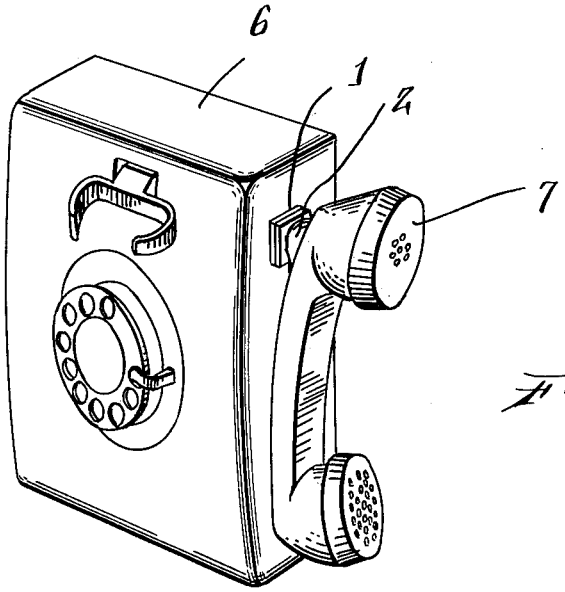
Fig. 3.

REMOVABLE TWO-PART FASTENING FOR TEMPORARILY HANGING AN OBJECT FROM A SURFACE

BACKGROUND OF THE INVENTION

The broad concept of two-piece attachments involving a ball and a socket type is not new. The closest prior art is represented by the Johnson Pat. No. 3,389,883. In this patent the socket portion is rigidly and permanently attached to a wall by screws or other means, and the hemispherical socket is provided with a deep curving slot. The ball portion is provided with a narrow neck which extends down into the slot and is rigidly attached or forms a part of a dispenser, such as a dispenser for paper or plastic cups. It is essential that the dispenser be held strongly and vertically and parallel to the wall or other attaching surface. In order to make this possible, the neck connecting the ball and the ball surface contacts with fingers, which are formed of the socket itself and which hold the two elements rigidly and strongly in parallel relation but spaced from the wall. The fingers also contact surfaces on the dispenser itself. Holding is by the slot and fingers and not by the socket itself.

Another proposal is found in the Staver Pat. No. 3,125,824, in which a rigid, double conical insert is molded into a cake of soap. The double cone has curved surfaces and can be held between two fingers when the soap is used. In one of the figures, FIG. 4, the double conical insert carries a ball which snaps into a socket on a bracket rigidly attached either to a washstand or a wall surface. The material being held, the soap, cannot swing against the surface and the socket does not have a portion which bears against the ball after it is slid in; the only holding is by the springiness of the ball and socket, which is quite weak, and while not inoperative with pieces of soap is completely unsuitable for other objects, which can be heavier and which should be able to swing against a supporting surface.

SUMMARY OF THE INVENTION

The present invention uses two elements which though of the general ball and socket type are especially constructed with only a portion of the socket surrounding the ball and leaving an opening on one side in which the ball can be slid in, contacting the portion of the socket surrounding. This portion in the socket or female element pulls down against the ball so that the two elements are held together by gravity and the joint permits some movement and is not rigid as in the Johnson patent referred to above. In the present invention the object being hung must be able to swing through a small arc so that its lower end strikes the supporting surface, which may be a vertical wall telephone box or a wall for the preferred form in which the invention is used for hanging a telephone receiver which has been taken off the hook.

The limited movement of the joint permits the bottom end of the object, such as telephone receiver, to swing against the surface on which it is being hung. This makes possible a firm but somewhat movable attachment to that the force of gravity pulls the ball against the portion of the socket surrounding it and holds it there; in other words, this portion of the socket acts as a hook and with the object swung so that its lower end strikes the attaching surface it cannot jump out but has to be raised intentionally and moved out through the open side of the socket.

It is not necessary that the joint be a spherical ball with a partial hemispherical socket open on one side. Other shapes, in which the male member, for example, can be a diamond with a suitable contouring of the socket, may be used. It is essential, however, that the socket be oriented with the closed or surrounding portion pointing up so that the force of gravity firmly hangs the object, to which the socket is preferably attached, which has swung slightly so that its lower end strikes the surface to which the fastening is attached. In other words, this is an entirely different mechanical design from the Staver patent, where holding is simply by a springy, partially spherical socket.

Because the fastening permits hanging quite long and heavy objects, such as garden tools or even a sledge hammer, it is necessary that the elements of the joint be firmly attached to the surface. With fairly light objects, such as telephone receivers, this is preferably effected by a pressure sensitive adhesive. However, where the object is very heavy, such as a sledge hammer, stronger fastenings by screws and even the use of metal in the socket and its ball or other male element may be desirable. Where the fastening is on a flat surface, as a wall telephone box or wall, the elements are integral with flat pedestal. Of course, where there is a large curvature, as in a rake or a sledge hammer, the pedestal should have a suitable matching contour. In other words, one of the pedestals may not be flat, though usually, since one of the elements is being attached to a wall or other flat surface, one of them is.

It should be noted that the fastening holds the male member by the surrounding portion of the socket against which it is forcibly held by the force of gravity, and as the object which is being hung is free to swing slightly so that its lower portion contacts the wall or other surface, it cannot jump out.

It should be noted that there are only two elements in the fastening of the present invention; and the additional elements, such as the slots, fingers, and such like, of the Johnson patent which hold a dispenser rigidly, spaced from the wall at least at its bottom end, are not required and are not used. However, because the object being held can swing through a small arc and strike the wall or other surface at its lower end, the support is very strong, and though the additional elements of the Johnson patent have been displaced with, their function, as far as the present invention is concerned, has not been eliminated.

The male and female elements of the fastening portion of the present invention, which will often be referred to generically as ball and socket, may have smooth surfaces. For preferred uses, such as telephone receivers, where the fastening elements are molded from plastic, this is very satisfactory and presents a very low cost form. However, the surface need not be smooth and can be somewhat rough.

It should be noted that in the present invention the device or element which is being hung must be elongated so that it can swing with its bottom end contacting the surface from which it is being hung, which prevents jumping out once the device is hung.

One of the preferred attachments is a pressure sensitive adhesive layer which grips both the plastic on one side and the surface to which it is attached. Other methods of removable fastening may be used. For example, if one of the surfaces is a ferromagnetic metal, the attachment can be by a powerful permanent magnet. However, the pressure sensitive adhesive is preferred since it can be attached to any kind of surface and is, of course, much cheaper than very powerful permanent magnets.

One of the most important uses is on a telephone handset or receiver, which is often desired to be temporarily attached to the telephone while the user wants to have both hands free, or, of course, it may be attached to any other surface, such as a wall. The present invention is not intended for and is not suitable for fastening elements together which are to be held rigid as in the dispenser of the Johnson patent. In its field, however, it represents an extremely cheap and very satisfactory article.

It should be noted that in the present invention there are only two elements, the ball and the socket. Yet, for its purpose, it operates as satisfactorily as, for examaple, the Johnson patent with other additional elements. In fact, for its preferred uses it is much better because normally light elements, such as a telephone receiver, should be attached with a reasonable amount of rotational flexibility. This, of course, is something which the Johnson patent does not have. Also, while there is a socket at one side, it does not have a slot capable of clamping tightly on a narrow neck extending to the ball. This is another element which is not used but its function is not eliminated.

BRIEF DESCRIPTION OF THE DRAWINGS

FIG. 1 is an exploded view of the two elements of the present invention;

FIG. 2 is a side view of the two elements connected together, partly in section and partly broken away, and FIG. 3 is a diagrammatic illustration of a typical use of the invention for holding a telephone receiver.

DESCRIPTION OF THE PREFERRED EMBODIMENTS

FIGS. 1 and 2 show the two elements of the present invention, that is, a ball and socket. In FIG. 1 they are shown exploded and in FIG. 2 connected together. As both elements are mounted on bases of the same general construction, the bases are given the same reference numeral. The elements are preferably molded of plastic and each has a base or pedestal 1 with a pressure sensitive adhesive 3 and a paper cover 4, which is removed before use. In FIG. 1 the cover on the adhesive layer for the ball base is shown partly peeled away at one corner.

The ball element 5, which is mkost clearly seen in FIG. 2 can be slid into the socket 2, which is molded to its base 1. The open side of the socket is pointing down and is attached to the object being held, as will be described below, which is a telephone receiver, is elongated and so can swing so that its bottom end contacts the surface to which it is to be attached. As this makes for a straight up-and-down pull, a pressure sensitive adhesive is quite adequate because it is involved in extensive shear and is not being pulled off from the surface to which it is attached.

FIG. 3 shows diagrammatically a wall telephone box at 6, a receiver at 7, the socket 2 and its base attached to the receiver or handset, and the ball and its base being attached to the surface of the telephone box. The socket is less in the way when the telephone is being used than a ball would be and so it is preferred to make the attachment as shown in FIG. 3. The telephone box is, of course, shown purely diagrammatically as the present invention does not change the structure of the box. Thus, for example, no wires are shown but are, of course, present.

When the telephone receiver is temporarily hung from the telephone box by the present invention, this makes it possible to hang the telephone when it has been answered and someone else is called to it or where the user may desire temporarily to have the use of two hands, for example when notes are to be made. When the attachment is to a wall, where the telephone box is not a permanently fastened wall telephone box, the attachment can be to any adjacent wall. It should be noted that the receiver is held firmly by gravity but still can be readily removed by deliberately sliding it up and out of the socket.

I claim:

1. A removable two-part fastener for hanging an elongated element from an extended, substantially planar surface, comprising, in combination, a. a male element including a base portion having a substantially planar surface rigidly connected to the male element, b. a socket for female element mating with the male element but surrounding it only on some sides, having a portion of a side open, whereby the male element slides into the socket, c. an elongated element and adhesive means for detachably fastening the base of the socket to the elongated element, the base portion of the male element having likewise adhesive fastening means, the base of the female element being attachable to the elongated element with the open side of the female element or socket pointing down, whereby when the elongated element to which the socket is fastened is hung, it can swing through a small arc sufficient for the lower end of the elongated element to contact the extended surface, thus preventing accidental jumping out of the male element, which is held firmly by the force of gravity.

2. A device according to claim 1 in which the male member is a ball and the female member is a mating socket.

3. A device according to claim 1 in which the ball and socket are of molded plastic, including the bases, which are integral with ball and socket, respectively.

* * * * *